US005709501A

United States Patent [19]

Elbers

[11] Patent Number: 5,709,501

[45] Date of Patent: Jan. 20, 1998

[54] BOAT HOIST COVER ASSEMBLY

[76] Inventor: Gary M. Elbers, 8626 Port Said St., Orlando, Fla. 32817

[21] Appl. No.: 675,108

[22] Filed: Jul. 3, 1996

[51] Int. Cl.[6] ..... B63C 3/06; B63B 17/02

[52] U.S. Cl. ..... 405/3; 405/1; 114/44; 114/361

[58] Field of Search ..... 405/1–7; 114/44, 114/361, 343, 365, 366, 376

[56] References Cited

U.S. PATENT DOCUMENTS

| | | | |
|---|---|---|---|
| 149,752 | 4/1874 | Harris . | |
| 296,820 | 4/1884 | Braun . | |
| 524,137 | 8/1894 | Enright . | |
| 572,641 | 12/1896 | Kriner . | |
| 984,850 | 2/1911 | Rathbun . | |
| 1,129,390 | 2/1915 | Hicks . | |
| 1,134,630 | 4/1915 | McGoldrick . | |
| 1,199,542 | 9/1916 | Gammel . | |
| 1,453,673 | 5/1923 | Hebert . | |
| 2,529,948 | 11/1950 | Jones | 405/3 |
| 2,708,346 | 5/1955 | Smith | 114/365 X |
| 4,019,212 | 4/1977 | Downer | 9/1.5 |
| 4,363,284 | 12/1982 | Monroe | 114/361 |
| 5,027,739 | 7/1991 | Lackovic | 114/361 |
| 5,058,946 | 10/1991 | Faber | 296/181 |
| 5,261,347 | 11/1993 | Mansfield | 405/3 X |
| 5,269,332 | 12/1993 | Osborne | 135/88 |
| 5,281,077 | 1/1994 | Phillips | 405/3 X |
| 5,593,297 | 1/1997 | Endres et al. | 405/3 |

FOREIGN PATENT DOCUMENTS

| | | | |
|---|---|---|---|
| 92/13755 | 8/1992 | U.S.S.R. | 114/361 |

*Primary Examiner*—Tamara L. Graysay
*Assistant Examiner*—Frederick L. Lagman
*Attorney, Agent, or Firm*—William M. Hobby, III

[57] ABSTRACT

A boat hoist and cover assembly apparatus and method uses a boat hoist having a rotatable lift shaft having a plurality of ropes or cables coiled therearound in one direction of rotation and extending therefrom for removably coupling to a boat for lifting a boat by the rotation of the hoist lift shaft. A boat cover has a plurality of cables or ropes attached thereto and coiled around the boat hoist lift shaft in a second direction of rotation from that of the boat hoist ropes to thereby lower the boat cover when hoisting the boat and to raise the boat cover when lowering the boat so that a boat cover covers a boat whenever the boat is hoisted by the boat hoist. The method uses the selected boat hoist and cover assembly and rotates the boat hoist shaft to lift an attached boat while lowering the boat cover onto the boat. Grease cups attach over the boat hoist lift shaft sleeves or bearings to catch the grease while preventing lubricants from dripping on the boat cover or boat.

13 Claims, 4 Drawing Sheets

BOAT HOIST COVER ASSEMBLY

BACKGROUND OF THE INVENTION

The present invention relates to a boat hoist and cover assembly and method and especially to a boat cover which covers the boat when a boat is hoisted with a boat hoist.

In the past, it has been common to provide boat decks and boat houses for the maintaining of boats when the boats are not being used. Typically, such boat docks have an open framework having a roof mounted thereover and may be provided with sidewalls so that the boat can be driven directly into the boat house. It is common to provide a boat hoist or winching mechanism for attaching ropes or cables to the boat and then elevating the boat out of the water supported on the framework beneath the roof. It is also old to provide canvas or flexible covers for a boat so that the cover can be drawn over the top of the boat and held therearound with draw ropes at the peripheral edge thereof for retaining the lower edge portion of the canvas in abutting relationship to the sides of the boat. Boat covers typically cover boats when they are out of water, such as on trailers, and even when they are in the water and moored for extended periods of time to protect the tops of the boats. Some boat owners also cover their boats when they are not going to be used for a period of time even though they are kept within the boat house and elevated above the water under the roof of the boat house. This is to prevent an accumulation of dirt, moisture, and the like when the boat is not going to be used for any extended period of time. However, this becomes a difficult operation to attach and remove the boat cover since the boat is being suspended from ropes or cables during the time the boat is being covered. The absence of a separate cover over the boat will allow dirt, insects, and the like to accumulate on the interior of the boat. The present invention is directed towards a boat hoist and cover which automatically covers the boat whenever the boat is hoisted within the boat house and automatically removes the boat cover when the boat hoist lowers the boat into the water. It also provides protection against the dripping of lubricants onto the boat cover or boat from the boat hoist.

In the Downer U.S. Pat. No. 4,019,212, a boat cover apparatus is provided which provides a manual lift system mounted to a frame for lifting a boat above the water and includes cables for attaching and lifting the boat. A boat cover is attached to a specially designed frame shaped to fit over the sides of the boat and is supported from flexible cords or cables and has a hand wench so the cover can be lowered or raised manually after the boat has been lifted. Thus, the boat is manually lifted with a manual boat hoist and then, in a separate operation, a frame having a cover attached is lowered with a separate hand wench down over the top of the boat.

In the Osborne U.S. Pat. No. 5,269,332, a retractable protective cover for boats, cars, and the like is operated with a manual wench pulling a cover through an elongated tube where it is retracted and extended for covering the car or the like. The Faber U.S. Pat. No. 5,058,946, is a hinged trailer boat cover which has a rigid boat cover mounted to a trailer for covering the boat when towing the boat on the trailer or for storage on the trailer. The Lackovic U.S. Pat. No. 5,027,739, is a demountable cover for a boat hatchway or the like which swings a cover on a supporting arm. The Enright U.S. Pat. No. 524,137, is a portable awning for vessels supported from a boom arm. The McGoldrick U.S. Pat. No. 1,134,630, is a life boat and launching mechanism therefor.

Prior art drip cups and grease guards for mounting over journal bearings or the like can be seen in U.S. Pat. No. 296,820 for a drip cup for journal bearings and in the Harris U.S. Pat. No. 149,752, for drip cups for valves and journals and in the Kriner U.S. Pat. No. 572,641, for an oil catching device and in the Rathbun U.S. Pat. No. 984,850, for a drip cup and the Hicks U.S. Pat. No. 1,129,390, for a combination drip pan and wiper and in the Gammel patent, U.S. Pat. No. 1,199,542, for an oil catch basin and in the Hebert U.S. Pat. No. 1,453,673, for an oil shield for belt pulleys.

In contrast, the present invention adapts a boat hoist which coils ropes or cables around a central shaft for lifting a boat and which automatically lowers a boat cover onto the boat when lifting the boat and raises the boat cover when lowering the boat to avoid the complexities of covering a boat in a boat house when storing the boat.

SUMMARY OF THE INVENTION

A boat hoist and cover assembly apparatus and method uses a boat hoist having a rotatable lift shaft having a plurality of ropes or cables coiled therearound in one direction of rotation and extending therefrom for removably coupling to a boat for lifting a boat by the rotation of the hoist lift shaft. A boat cover has a plurality of cables or ropes attached thereto and coiled around the boat hoist lift shaft in a second direction of rotation from that of the boat hoist ropes to thereby lower the boat cover when hoisting the boat and to raise the boat cover when lowering the boat so that a boat cover covers a boat whenever the boat is hoisted by the boat hoist. The method uses the selected boat hoist and cover assembly and rotates the boat hoist shaft to lift an attached boat while lowering the boat cover onto the boat. Grease cups attach over the boat hoist lift shaft sleeves or bearings to catch the grease while preventing lubricants from dripping on the boat cover or boat.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
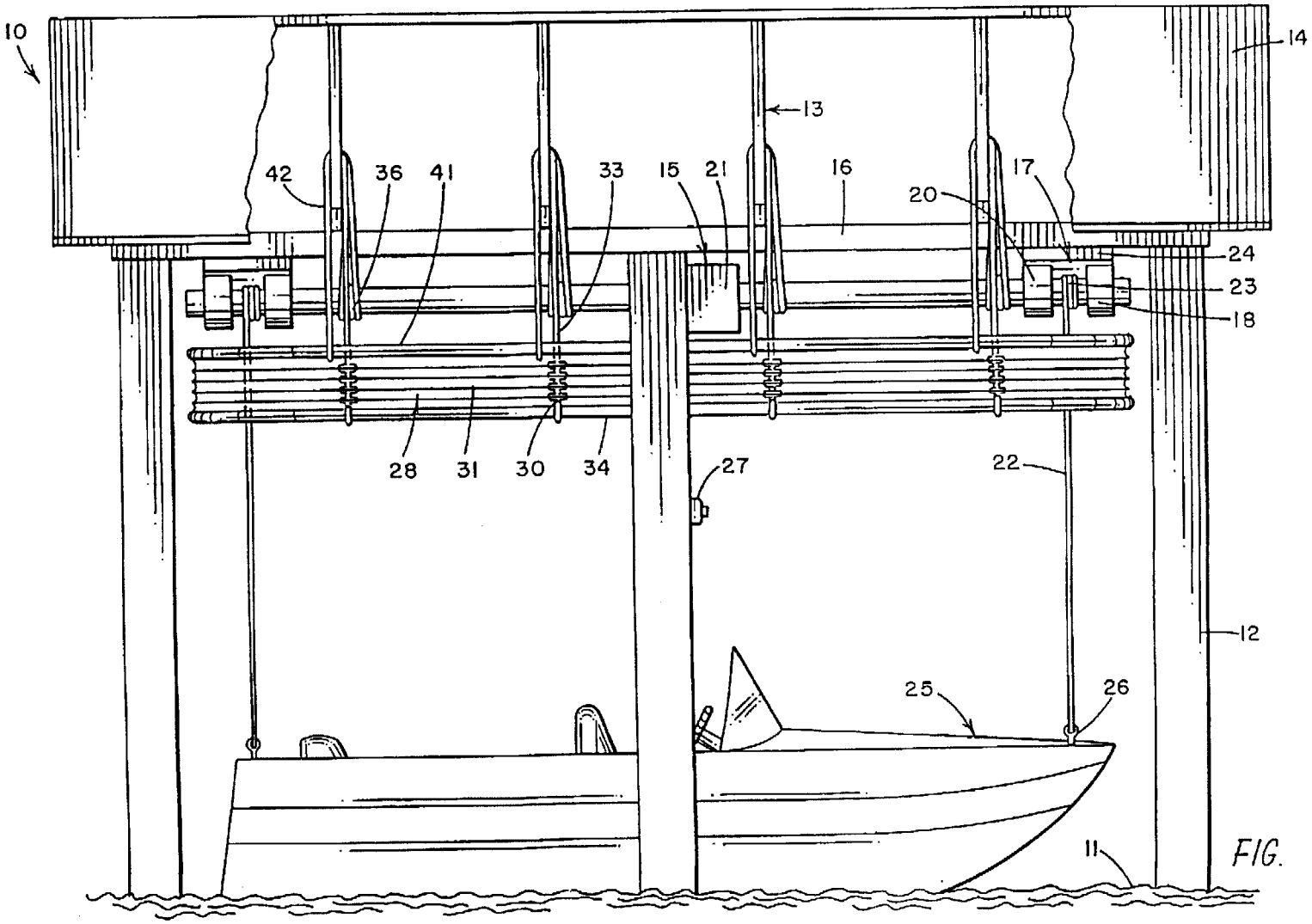
FIG. 1 is a side elevation of a boat dock having the boat hoist and cover assembly of the present invention.

Referring to the drawings and especially to FIGS. 1–3B, a boat house 10 is shown mounted in a body of water 11 with a plurality of pilings 12. The boat house has a roof frame 13 with a roof thereover supported on the pilings 12. The boat house has a boat hoist 15 mounted therein which includes a boat lifting rotatable shaft 16 supported at each end with support straps 17 having straps 18 and 20 for rotatably supporting the shaft 16. An electric motor 21 rotates the shaft and is reversible to rotate the shaft in a clockwise or counterclockwise direction as desired by the operator. A boat hoist has a plurality of cables, cords, or ropes 22 which are attached to the shaft and are coiled at 23 around the shaft 16 between the support straps 18 and 20. Support straps 18 and 20 are supported from a base plate 24 which is attached to the boat house frame 13. The cables 22 are shown attached to a boat 25 through eyelets or cleats 26 attached to each end of the boat for attaching the cables 22 for lifting the boat. An activation switch 27 is mounted to a piling 12, even though it should be clear that the control 27 can be mounted from any place desired to activate the electric motor 21 in a forward or reverse direction.

Figure 2:
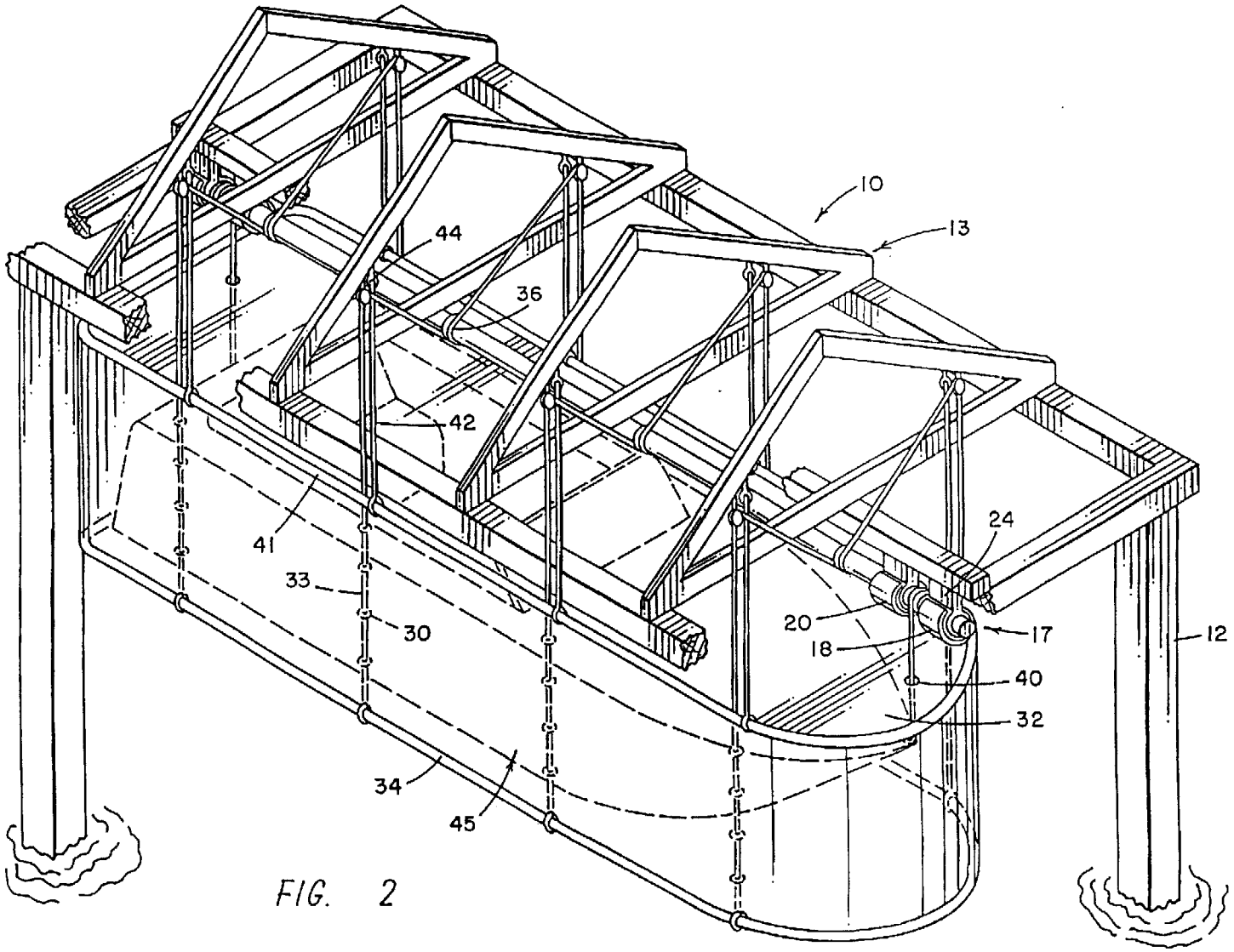
FIG. 2 is a perspective view of a portion of the boat house having the boat cover in place.
Figure 3A:
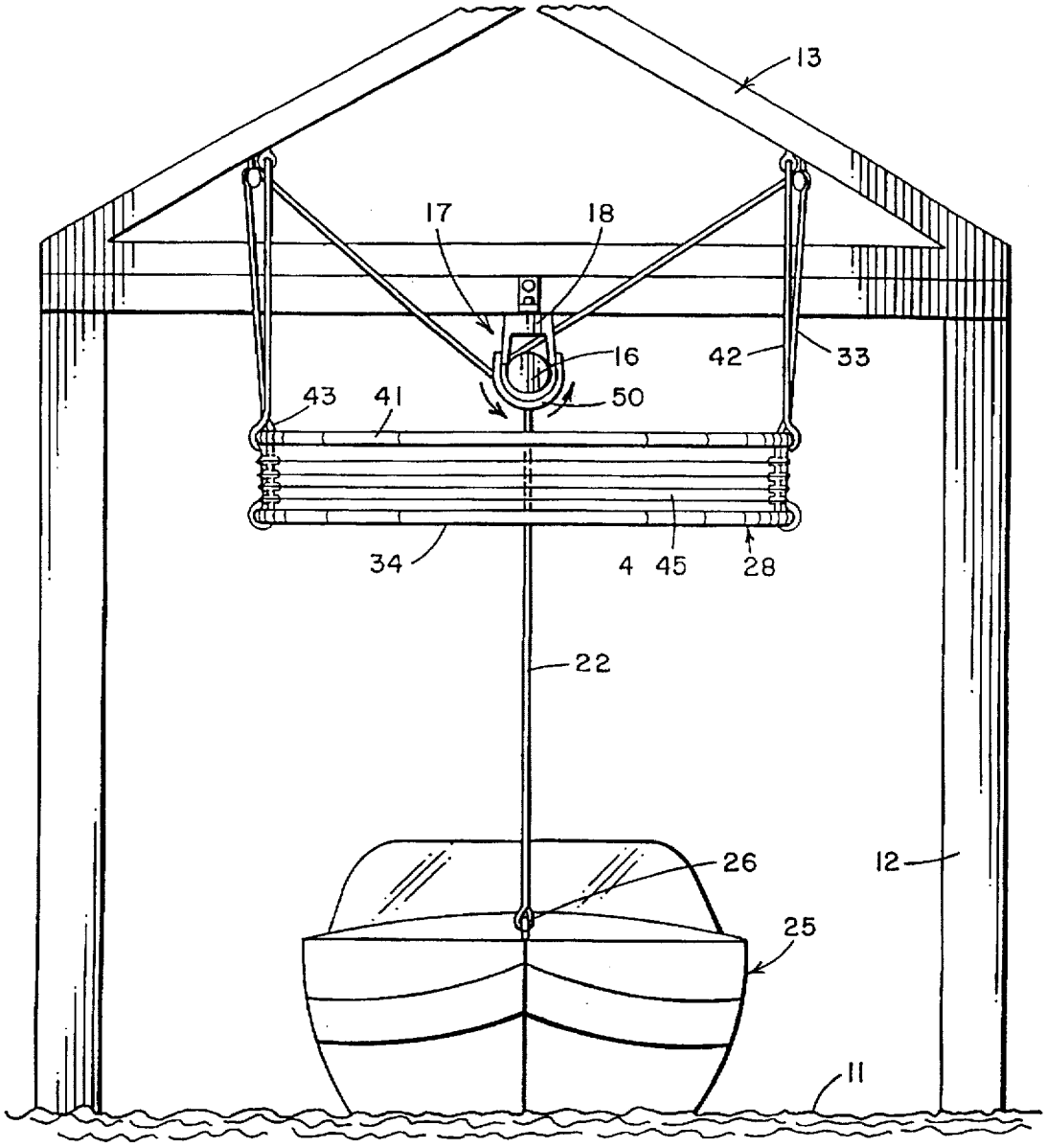
FIG. 3A is an end elevation of the boat house of FIGS. 1 and 2 having the boat lowered and the cover raised.
Figure 3B:
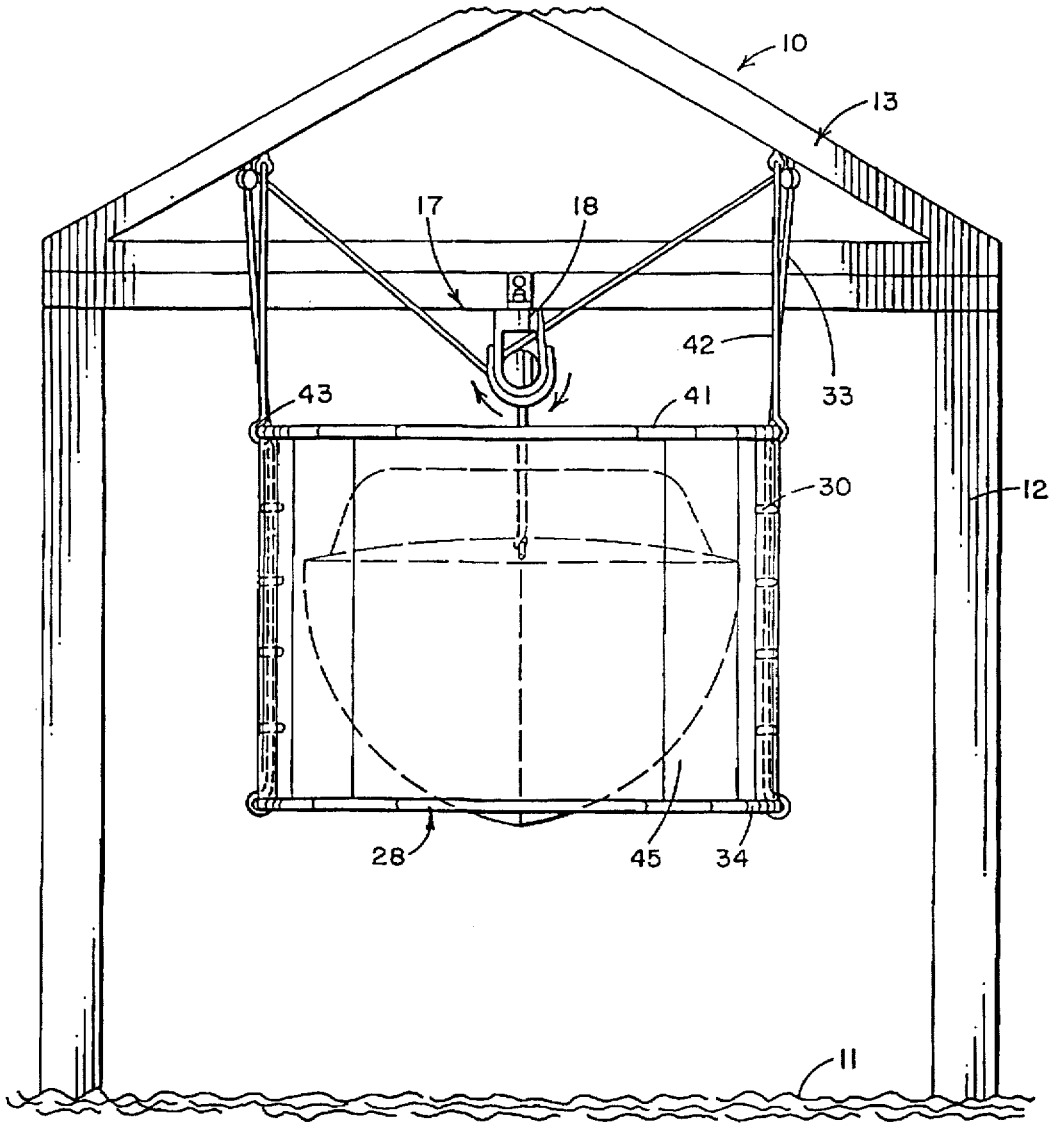
FIG. 3B is an end elevation in accordance with FIG. 3A having the boat lifted and the boat cover lowered.
Figure 5:
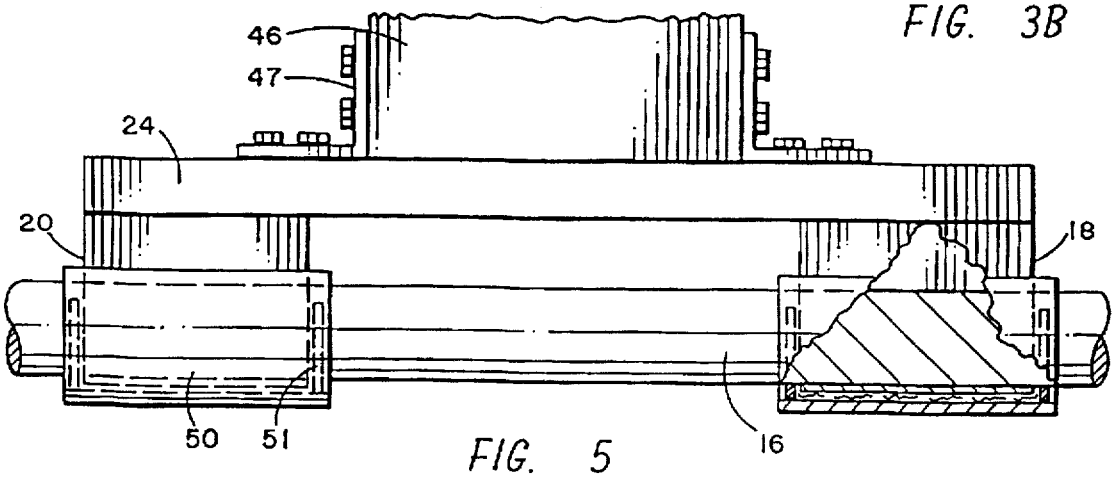
FIG. 5 is a broken away side elevation of the hoist shaft having grease cups therearound.

In normal operation of the hoist, the motor 21 is activated in one direction of rotation to coil 23 the cable 22 around the shaft 16 which thereby lifts the boat 25, as shown in FIGS. 2 and 3B. Activating the switch 27 to rotate the motor 21 in an opposite direction of rotation will then lower the cable 22 off the coiled cable 23 on the shaft 16 to lower the boat until the boat is floating in the water 11 where the cables 22 can be disconnected from the eye supports 26.

A boat cover 28 is shown in a raised position in FIGS. 1 and 3A and in a lowered position in FIGS. 2 and 3B and has a plurality of supporting eyelets or guides 30 thereon along the side 31 thereof. The boat cover also has a top cover 32. A plurality of cables 33 are connected to the bottom edge 34 of the cover 28 and around pulleys 35 attached to the roof framework 13 and then are coiled 36 around the shaft 16 in the opposite direction of the coils 23 and are attached to the shaft 16. Any time the motor 21 is activated to rotate the shaft 16, it will coil the cable 22 in one direction to lift the boat while coiling the cable 36 in the opposite direction to lower the cover 28. Similarly, when the boat 25 is being lowered by rotating the shaft 16 to uncoil the coil 23 and release the cable 22 to lower the boat, the cable 33 is being coiled onto the shaft 16 to thereby lift the boat cover 28 by raising the cables 23 to pull the boat cover out of the way in a raised position, as shown in FIGS. 1 and 3A. The boat cover 28, top 23 has a pair of holes 40 therethrough for the cable 22 to pass therethrough for attaching to the boat 25 while the bottom edge 34 of the cover 28 can be a tubular framework or the like. The cover may also have a top framework 41 which has a plurality of cables 42 attached thereto with eyelets 43 or the like. Cables 42 are attached to the framework 13 by eyelets 44 or the like so that the rotation of the shaft 16 will raise and lower only the lower framework 34 to thereby space the side of the boat cover 45.

Figure 4:
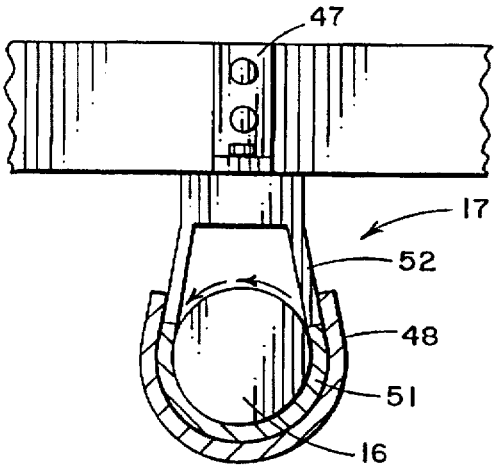
FIG. 4 is a sectional view taken through the boat hoist shaft supporting strap.

The hoist 15 shaft 16, as shown in FIGS. 3A, 3B, 4, and 5 has to be lubricated with a grease to maintain the smooth operation of the rotating shaft 16. The straps 18 or 20 are mounted to a base 24 and mounted to a frame member 46 with steel braces 47. The straps 18 and 20 are lubricated to keep them operating smoothly but tend to drip small amounts of grease onto a boat being supported thereunder. A grease cover and seal 48 has been provided which may be a polymer U-shaped body 50 having a fibrous or porous sealing material 51 on each end thereof and may be shaped in an arcuate fashion, as shown in FIG. 4, so that it snaps over the shaft supporting straps 52 to thereby cover the strap portion supporting the shaft 16 and to capture any grease or lubricant that might leak therefrom where it is stopped by a nonporous seal 51. The grease cup seals 51 stop the grease from passing by the seal. This cup and seal maintains a continuous lubricant of the shaft 16 as well as prevents the dripping of the grease onto the boat or onto the boat cover where the boat or boat cover can be damaged. Thus, the sealed body 50 is snapped onto the strap portions 18 or 20 of the boat hoist 15.

It should be clear at this time that a boat hoist and boat cover assembly has been provided which automatically covers the boat with a boat cover any time the boat is hoisted with the boat hoist and automatically removes the boat cover from the boat whenever the boat is lowered into the water. It should also be clear that a method of operation provides for automatically lowering the boat by the rotation of a central hoist shaft in one direction which automatically coils the cables or ropes to raise the boat cover while lowering the boat and rotating the shaft in the opposite direction raises the boat while lowering the boat cover onto the boat. However, the present invention should not be considered as limited to the forms shown which are to be considered illustrative rather than restrictive.

I claim:

1. A boat hoist and cover assembly comprising:

a boat hoist having a rotatable lift shaft and a plurality of ropes coiled therearound in one direction of rotation and extending therefrom for removably coupling to a boat for lifting a boat coupled thereto by rotation of said hoist lift shaft; and a boat cover having a plurality of ropes attached thereto, each of said plurality of cords being coiled around said boat hoist lift shaft in a second direction of rotation from said boat hoist ropes to lower said boat cover when lifting said boat and to raise said boat cover when lowering said boat, whereby a boat cover covers a boat whenever the boat is hoisted by said boat hoist.

2. A boat hoist and cover assembly in accordance with claim 1 in which said boat cover is a flexible fabric boat cover.

3. A boat hoist and cover assembly in accordance with claim 2 in which each said boat hoist rope passes through said boat cover when supporting a boat beneath said cover.

4. A boat hoist and cover assembly in accordance with claim 3 in combination with a boat house in which said boat hoist is attached to said boat house.

5. A boat hoist and cover assembly in accordance with claim 4 in which each said boat hoist rope is attached to said shaft to thereby coil therearound when said shaft is rotated in one direction of rotation and to uncoil when said shaft is rotated in a second direction.

6. A boat hoist and cover assembly in accordance with claim 5 in which each said boat cover rope is attached to said shaft to coil therearound when said shaft is rotated in a second direction of rotation and to uncoil when said shaft rotates in one direction of rotation.

7. A boat hoist and cover assembly in accordance with claim 1 in which said shaft is an elongated metal shaft riding in at least two support straps, each strap having a cover guard removably attached thereover.

8. A boat hoist and cover assembly in accordance with claim 7 in which each said cover guard clips onto said strap beneath said strap to thereby prevent any grease from dropping onto a boat or boat cover.

9. A boat hoist and cover assembly in accordance with claim 8 in which said cover guard has a flexible porous material mounted on each end thereof to thereby absorb grease caught therein for lubrication of said strap.

10. A boat hoist and cover assembly in accordance with claim 1 in combination with a boat in which each said boat hoist rope extends around a lifting pulley and attaches to said boat positioned thereunder.

11. A boat hoist and cover assembly in accordance with claim 10 in which said each boat cover rope extends around a pulley and is attached to said boat cover.

12. A boat hoist and cover assembly in accordance with claim 11 in which each said boat cover rope extends through a plurality of eyes mounted to said cover for lifting said cover when said cover is pulled up by said boat hoist shaft.

13. A method of lifting and covering a boat comprising:

selecting a boat hoist having a rotatable lift shaft and a plurality of ropes or cables coiled therearound in one direction of rotation and extending therefrom for removably coupling to a boat for lifting a boat coupled thereto by rotation of said hoist lift shaft;

selecting a boat cover having a plurality of ropes or cables attached thereto, each of said plurality of ropes or cables being coiled around said boat hoist lift shaft in a second direction of rotation from said boat hoist ropes or cables;

rotating said selected boat hoist shaft to lift an attached boat and to lower said boat cover onto said boat to thereby cover a boat whenever the boat is hoisted by said boat hoist.

* * * * *